US011089658B2

(12) United States Patent
Lim et al.

(10) Patent No.: US 11,089,658 B2
(45) Date of Patent: Aug. 10, 2021

(54) HEATING ELEMENT

(71) Applicant: NDT ENGINEERING & AEROSPACE CO., LTD., Gyeongsangnam-do (KR)

(72) Inventors: Ki-Hyun Lim, Gyeongsangnam-do (KR); Chi-Woo Noh, Gyeongsangnam-do (KR)

(73) Assignee: NDT ENGINEERING & AEROSPACE CO., LTD., Gyeongsangnam-do (KR)

( * ) Notice: Subject to any disclaimer, the term of this patent is extended or adjusted under 35 U.S.C. 154(b) by 241 days.

(21) Appl. No.: 16/311,145

(22) PCT Filed: May 19, 2017

(86) PCT No.: PCT/KR2017/005231
§ 371 (c)(1),
(2) Date: Dec. 18, 2018

(87) PCT Pub. No.: WO2017/222192
PCT Pub. Date: Dec. 28, 2017

(65) Prior Publication Data

US 2019/0182906 A1 Jun. 13, 2019

(30) Foreign Application Priority Data

Jun. 22, 2016 (KR) ..... 10-2016-0077934

(51) Int. Cl.
*H05B 3/04* (2006.01)
*H05B 3/03* (2006.01)
*H05B 3/34* (2006.01)

(52) U.S. Cl.
CPC ..... *H05B 3/04* (2013.01); *H05B 3/03* (2013.01); *H05B 3/34* (2013.01);
(Continued)

(58) Field of Classification Search
CPC ... H05B 3/04; H05B 3/03; H05B 3/34; H05B 3/342; H05B 3/146; H05B 2203/013;
(Continued)

(56) References Cited

U.S. PATENT DOCUMENTS 9,668,301 B2 5/2017 Lim

FOREIGN PATENT DOCUMENTS

JP S53102148 8/1978
JP 2003174952 A 8/2003
(Continued)

*Primary Examiner* — Shawntina T Fuqua
(74) *Attorney, Agent, or Firm* — Wells St. John P.S.

(57) ABSTRACT

The present invention relates to a wet planar heating element and a method manufacturing the same. The element including: a planar heating unit including an upper waterproof film layer, a lower waterproof film layer, a planar heating layer, and an electrode layer; an external waterproof film layer; and a non-woven fabric layer. According to the present invention, it is possible to minimize leakage current due to pores of a non-woven fabric substrate and a low dielectric constant of air in air pockets, thereby solving problems that an earth leakage circuit breaker operates. Accordingly, wet construction can be performed, power consumption can be reduced, and an electrical fire risk can be remarkably lowered. In addition, it is possible to improve flexibility of the planar heating element, whereby the use of the planar heating element can be expanded and the efficiency of the construction work can be increased.

2 Claims, 3 Drawing Sheets

(52) U.S. Cl.
CPC .. *H05B 2203/013* (2013.01); *H05B 2203/017* (2013.01); *H05B 2203/02* (2013.01)

(58) Field of Classification Search
CPC ..... H05B 2203/02; H05B 2203/017; H05B 2203/016; H05B 2203/026; H05B 1/0294; H05B 2214/04
See application file for complete search history.

(56) References Cited

FOREIGN PATENT DOCUMENTS

| | | | | |
|---|---|---|---|---|
| JP | 2010091185 | | | 4/2010 |
| JP | 2011-228018 | | | 11/2011 |
| JP | 2012-143654 | A | | 8/2012 |
| KR | 10-2011-0068620 | | | 6/2011 |
| KR | 10-1168906 | B1 | | 8/2012 |
| KR | 10-2014-0005649 | | | 1/2014 |
| KR | 10-1568375 | B1 | | 11/2015 |
| KR | 10-1593983 | | * | 2/2016 |
| KR | 10-1593983 | B1 | | 2/2016 |
| WO | WO9611654 | A1 | | 4/1996 |

* cited by examiner

Certificate of Test

| Korea Institute of Footwear Leather Technology<br>Address : 152, DangGamGeo-ro, Saseong-Ku, Busan, Korea<br>Tel.(051)897-9701~4,FAX:(051) 897-9766 | Certificate No.: T-19-0758<br>Page: 1 (Total 1 Page) | KIFLT |
|---|---|---|

1. Client
   - Name : NDT ENGINEERING & AEROSPACE CO., LTD.
   - Address : 11, JAYUMUYEOK 4-GIL, MASANHOEWON-GU, CHANGWON-SI, GYEONGSANGNAM-DO, KOREA
2. Reception Date: MAY . 20 . 2019
3. Completion Date: MAY . 23 . 2019
4. Use of Report : SUBMISSION TO BUYER
5. Test Sample : ①PTC 1 ②PTC 2 ③PTC 3
6. Test Results :

| TEST ITEM | | UNIT | RESULTS | | | TEST METHOD |
|---|---|---|---|---|---|---|
| | | | ① | ② | ③ | |
| Flexural strength | A | N/2.54 cm | 29 | 9 | 13 | · Test speed : 10 mm/min<br>· Distance of bridge : 3 cm |
| | B | | 18 | 9 | 14 | |

※ specimen ※

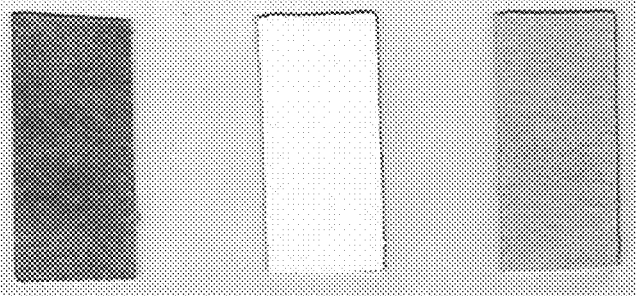

Korea Institute of Footwear Leather Technology

F-P-28-04(0) KIFLT A4(210×297mm)

FIG. 3

HEATING ELEMENT

CROSS REFERENCE TO RELATED APPLICATION

This is a 35 U.S.C. § 371 application of, and claims priority to, International Application No. PCT/KR2017/005231, which was filed on May 19, 2017, and claims priority to Korean Patent Application No. 10-2016-0077934, which was filed on Jun. 22, 2016, the teachings of which are incorporated herein by reference.

TECHNICAL FIELD

The present invention relates to a wet planar heating element and a method of manufacturing the same. More particularly, the present invention relates to a wet planar heating element and a method of manufacturing the same, the heating element evenly generating heat over a wide area thereof by a power supply, and enabling wet construction such that the heating element can be used for ondol, which is a Korean floor heating system, for floors, for wall heating materials, and for melting snow on a road.

BACKGROUND ART

In recent years, research and development of heat-generating materials for energy-saving and heating elements using the same have been accelerated, and advanced technologies for minimizing leakage current that occurs due to wet construction have been developed.

Until now, a wire heater has been mainly used as a heating element enabling of wet construction. However, because a wire heater is made of a heating material such as Ni—Cr and Fe—Ni—Cr, the power consumption is high due to a low thermal efficiency of wire heating. In addition, due to a serial circuit configuration, when one circuit is opened, the entire heating element does not generate heat, which means that maintenance is difficult. In addition, due to abnormal heat such as local overheating, there is a great risk of damage to the heating element and fire and there is a hazard risk in the product.

In addition, a carbon planar heating element is excellent in thermal efficiency compared to the wire heater. However, the carbon planar heating element applies conductive particles such as carbon black as a resistor heat source, which is problematic in that a resistance value changes greatly due to repetitive use. In addition, there is a great risk of damage to the heating element and fire due to an abnormal heating phenomenon such as local overheating, and there is a hazard risk in the product.

In order to ensure safety of the product, a temperature control system such as an overheat sensor has been considered to be provided on the wire heater and the planar heating element, but the temperature control system causes an abnormal heating phenomenon such as local overheating. A main reason of the abnormal heating phenomenon is thermal insulation, heat storage, and overheating. In particular, temperature of a thermal storage portion rises sharply, and local overheating of the heating element damages finishing materials, which causes an electrical fire.

However, when a planar heating element having a relatively high thermal efficiency is used as a heating element for wet construction in overcoming the problems of the wire heater currently being applied for wet construction, there is a problem in that the earth leakage circuit breaker operates due to a sudden increase in leakage current compared to the wire heater.

This is because the conventional planar heating element is mostly made of PET film for electrical insulation and flame retardancy and has been mainly used for dry etching construction. In addition, the PET film of the planar heating element, which is in contact with the bottom of a cement mortar when performing wet construction, has waterproofness due to interfacial contact with a wider floor surface compared to the wire heater and thus has drawbacks such as becoming damp and causing dew condensation.

On the other hand, Korea Patent No. 10-1168906 (issued on. Jul. 20, 2012) disclosed by the present applicant proposes a constant heater having a PET polymer film and using polymer PTC constant-temperature heating ink. A solution to problems such as improvement of polymer PTC characteristics by controlling various dopant addition amount and stabilization of room temperature resistance is provided in the above patent. With this patent, products have already been commercialized and exported to US and the like.

The above-mentioned patent has an advantage in that the polymer PTC constant heater is energy-saving and safe from an electrical fire due to a self-temperature control characteristic. However, the above-mentioned patent has difficulties as described above in application to heating for wet construction.

In order to solve the problems, the applicant of the present invention has proposed a wet planar heating element using polymer PTC constant-temperature heating ink in Korean Patent No. 10-1593983, for minimizing leakage current and induction current.

DISCLOSURE

Technical Problem

The present invention is intended to provide a wet planar heating element and a method of manufacturing the same, the heating element having flexibility and minimizing leakage current.

Technical Solution

In order to accomplish the above objectives, the present invention provides a wet planar heating element, the heating element including:

a planar heating unit having a planar heating unit including an upper waterproof film layer, a lower waterproof film layer, a planar heating layer interposed between the upper waterproof film layer and the lower waterproof film layer, and an electrode layer;

external waterproof film layers respectively provided on surfaces of the planar heating unit; and non-woven fabric layers respectively interposed between the planar heating unit and the external waterproof film layers, made of fibers in which pores are formed such that the non-woven fabric layers have multiple pores, and having irregularities on surfaces thereof, wherein recessed portions of the irregularities are closed by the external waterproof film such that air pockets are formed within the non-woven fabric layers.

Another objective of the present invention is to provide a method of manufacturing a planar heating element, the method including:

a first step in which a non-woven fabric layer 40*a* for construction and an external waterproof film layer 30*a* are laminated together and printed with a logo to obtain a first composite film;

a second step in which a non-woven fabric layer 20*a*, which is formed of fibers in which pores are formed such that the non-woven fabric layer 20*a* has multiple pores and irregularities on a surface thereof, and an upper waterproof film layer 11*a* are laminated together to obtain a second composite film;

a third step in which the first composite film and the second composite film are laminated together to obtain a third composite film;

a fourth step in which a non-woven fabric layer 40*b* for construction and an external waterproof film layer 30*b* are laminated together to obtain a fourth composite film;

a fifth step in which a non-woven fabric layer 20*b*, which is formed of fibers in which pores are formed such that the non-woven fabric layer 20*b* has multiple pores and irregularities on the surface thereof, and a lower waterproof film layer 11*b* are laminated together to obtain a fifth composite film;

a sixth step in which the fourth composite film and the fifth composite film are laminated together to obtain a sixth composite film;

a seventh step in which an electrode layer 13 is formed on one surface of the sixth composite film;

an eighth step in which a planar heating layer 12 is formed on an upper surface of the electrode layer; and a ninth step in which the third composite film and the sixth composite film provided with the electrode layer 13 and the planar heating layer 12 are laminated together.

Advantageous Effects

According to the present invention, it is possible to minimize leakage current due to a low dielectric constant of air in air pockets of non-woven fabric layers as well as due to pores of a non-woven fabric substrate, thereby solving the problem that an earth leakage circuit breaker operates due to a sudden increase in leakage current. Accordingly, wet construction can be performed, power consumption can be reduced, and an electrical fire risk can be remarkably lowered. In addition, it is possible to improve flexibility of the planar heating element by using the non-woven fabric, whereby the use of the planar heating element can be expanded and the efficiency of the construction work can be increased.

DESCRIPTION OF DRAWINGS

The accompanying drawings illustrate an embodiment according to the present invention and serve to explain the principles of the invention. It should be understood that the spirit of the present invention should not be construed as being limited to the accompanying drawings.

FIG. 3 is a test certificate for flexural strength of the planar heating element according to the embodiment of the present invention and the planar heating element of Korean Patent No. 10-1593983 disclosed by the applicant.

BEST MODE

Figure 1:
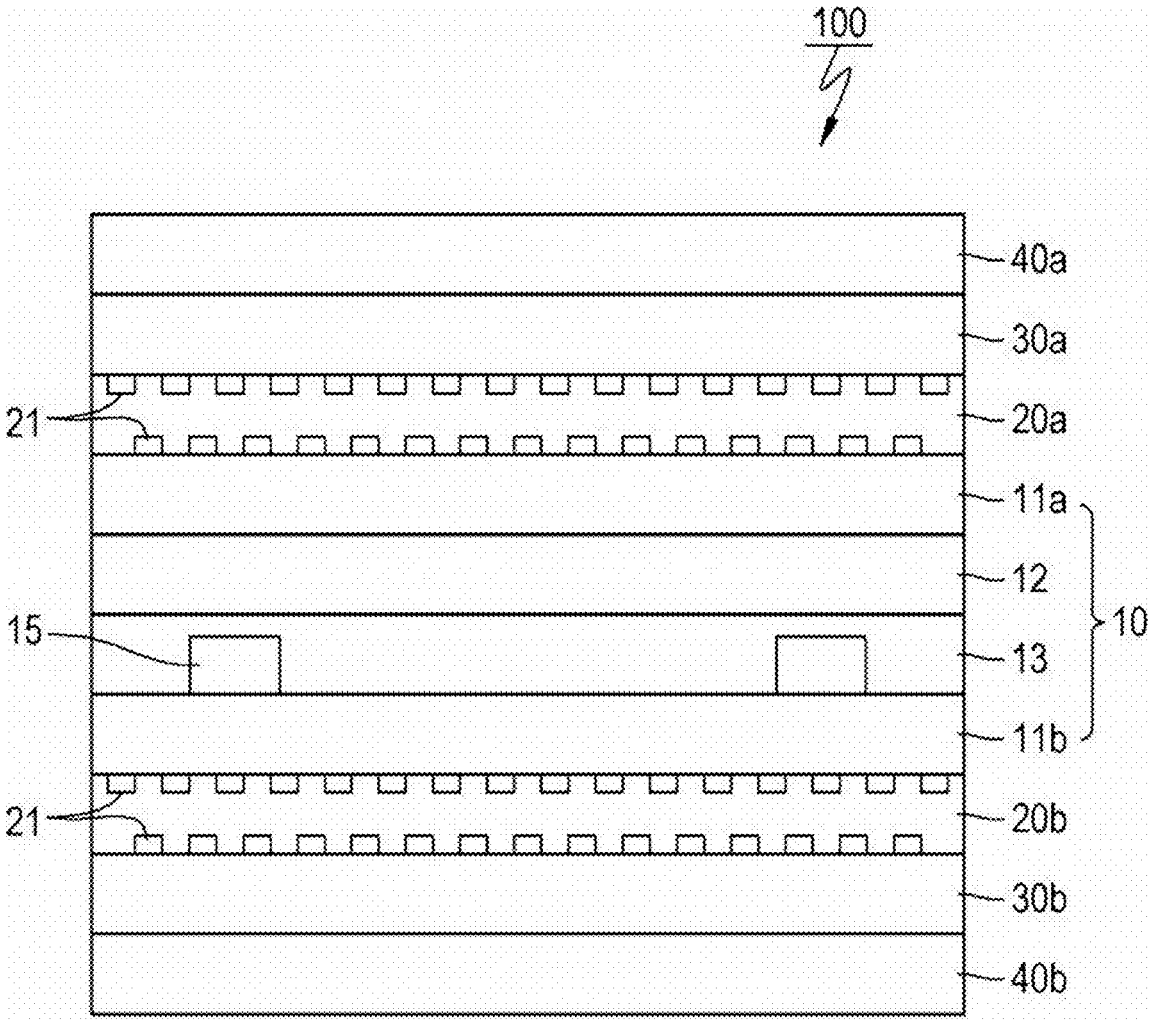
FIG. 1 is a schematic view illustrating a wet planar heating element according to an embodiment of the present invention.

Hereinbelow, preferred embodiments of the present invention will be described in detail with reference to the accompanying drawings such that the invention can be easily embodied by one of ordinary skill in the art to which this invention belongs. However, it should be understood that the embodiments of the present invention may be changed to a variety of embodiments and the scope and spirit of the present invention are not limited to the embodiment described hereinbelow.

In the following description, it is to be noted that, when the functions of conventional elements and the detailed description of elements related with the present invention may make the gist of the present invention unclear, a detailed description of those elements will be omitted. Wherever possible, the same reference numerals will be used throughout the drawings and the description to refer to the same or like elements or parts.

It is to be noted that the drawings are for reference only for the purpose of clearly and concretely explaining the preferred embodiments of the present invention and technical ideas or features, and therefore may be different from actual product specifications.

In addition, for convenience of understanding of the elements, sizes or thicknesses in the drawings may be exaggerated to be large or thick, may be expressed to be small or thin, or may be simplified for clarity of illustration, but due to this, the protective scope of the present invention should not be interpreted narrowly.

Terms such as 'a first ~' and 'a second ~' are used only for the purpose for distinguishing a constitutive element from other constitutive element, but constitutive element should not be limited to an order.

Throughout the description, it will be further understood that the terms "comprises", "comprising", "includes" and/or "including", when used herein, specify the presence of stated features, integers, steps, operations, elements, and/or components, but do not preclude the presence or addition of one or more other features, integers, steps, operations, elements, components, and/or groups thereof, unless the context clearly indicates otherwise.

FIG. 1 is a schematic view illustrating a wet planar heating element according to an embodiment of the present invention.

Referring to FIG. 1, the wet planar heating element 100 according to the embodiment of the present invention generates heat evenly over a wide area thereof by a power supply, enables wet construction such that the heating element can be used for ondol, which is a Korean floor heating system, for floors, for wall heating materials, and for melting snow on a road.

The wet planar heating element 100 includes a planar heating unit 10 including an upper waterproof film layer 11*a*, a lower waterproof film layer 11*b*, a planar heating layer 12 interposed between the upper waterproof film layer 11*a* and the lower waterproof film layer 11*b*, and an electrode layer 13.

The planar heating unit 10 may be formed of a constant heater of Korean Patent No. 10-1168906 disclosed by the present applicant.

The upper waterproof film layer 11*a* and the lower waterproof film layer 11*b* serve as upper and lower covers of the planar heating unit 10. The upper waterproof film layer

11*a* and the lower waterproof film layer 11*b* are used to prevent electricity applied to the planar heating unit 10 from escaping to the outside or the like and to impart waterproofness for performing wet construction. Therefore, the upper waterproof film layer 11*a* and the lower waterproof film layer 11*b* may be made of any material that imparts an insulating property and waterproofness without limitation. Specifically, the upper waterproof film layer 11*a* and the lower waterproof film layer 11*b* may be made of a material selected from the group consisting of polyethylene terephthalate, polypropylene, polyester, polystyrene, polyether ether ketone, polyethylene terephthalate glycol-modified, and polyethyleneimide, but the material is not limited thereto.

The planar heating element may be further provided with at least one layer selected from the group consisting of a metal film, a non-metal film, and a metal and non-metal mixed film by attaching thereto. An air layer may be formed in the metal film, the non-metal film, and the metal and non-metal mixed film. The metal film may be formed of aluminum, the non-metal film may be formed of a polymer or a ceramic, and the metal and non-metal mixed film may be formed of aluminum-polymer or aluminum-ceramic selectively. Specifically, it is preferable that the polymer film is polyethylene terephthalate and the metal and non-metal mixed film is aluminum-polyethylene terephthalate, but this is not limited thereto.

In particular, the metal film, the non-metal, and the metal and non-metal mixed film may be attached to one or both outermost surfaces of the planar heating element, but not limited thereto. Alternatively, at least one of those may be added between the multiple layers of the planar heating element as a layer of the planar heating element in an interposing manner.

The planar heating layer 12 is stacked on the electrode layer 13 and generates heat when electricity flows. It is preferable that the planar heating layer 12 is made of a material selected from the group consisting of conductive carbon, carbon black, graphene, carbon nanotubes (CNTs), graphite, or a mixture thereof. Specifically, the planar heating layer 12 may be a heat generating layer woven with carbon fibers, a heat generating layer in which a non-woven fabric is impregnated with CNTs or graphene, or a heat generating layer in which a non-woven fabric is impregnated with conductive carbon, or a heat generating layer in which a base film is coated with CNTs, graphene paste, or ink. A gravure coating may be performed for the coating.

Electrodes 15 are formed spaced a predetermined distance apart from each other on the planar heating layer 12 and the electrode layer 13 controls current flow between the electrodes 15 to raise and maintain a temperature of the planar heating layer 12. The electrodes 15 of the electrode layer 13 may be made of at least one material selected from the group consisting of a conductive polymer such as polyaniline, polypyrrole, and polythiophene, a conductive component such as carbon, and a metal such as silver, gold, platinum, palladium, copper, aluminum, tin, iron, and nickel. It is preferable that the electrodes 15 are made of copper having excellent thermal conductivity and electrical conductivity.

The wet planar heating element 100 according to the embodiment of the present invention including the planar heating unit 10 has a structure capable of minimizing a leakage current of the planar heating unit 10, which increases with an area of the wet planar heating element 100 when performing wet construction.

Accordingly, the wet planar heating element 100 according to the embodiment of the present invention further includes: external waterproof film layers 30*a* and 30*b* provided on both surfaces of the planar heating unit 10 respectively; and non-woven fabric layers 20*a* and 20*b* interposed respectively between the planar heating unit 10 and the external waterproof film layers 30*a* and 30*b*, and formed of fibers in which pores are formed such that the non-woven fabric layers 20*a* and 20*b* have multiple pores and irregularities formed on the surface thereof.

The external waterproof film layers 30*a* and 30*b* serve to minimize a leakage current generated in accordance with an increase of the area of the wet planar heating element 100 when performing wet construction, and impart waterproofness for performing wet construction. The external waterproof film layers 30*a* and 30*b* may be made of any material that imparts an insulating property and waterproofness, without limitation. Specifically, the external waterproof film layers 30*a* and 30*b* may be made of a material selected from the group consisting of polyethylene terephthalate, polypropylene, polyester, polystyrene, polyether ether ketone, polyethylene terephthalate glycol-modified, and polyethyleneimide.

The non-woven fabric layers 20*a* and 20*b* are formed of fibers and each of the non-woven fabric layers 20*a* and 20*b* has a non-woven fabric substrate having multiple pores.

The fibers forming the non-woven fabric substrate may have an average diameter of 0.1 μm to 10 μm. The fibers may be selected from the group consisting of a polyolefin such as polyethylene and polypropylene, a polyester such as polyethylene terephthalate, polybutylene terephthalate, a polyamide such as aramid, and polyacetal, polycarbonate, polyimide, polyether ether ketone, polyether sulfone, polyphenylene oxide, polyphenylene sulfide, polyethylene naphthalene, and the like, but not limited thereto.

The non-woven fabric layers 20*a* and 20*b* reduce an occurrence of a leakage current due to a low dielectric constant of air in the multiple pores of the fibers. Therefore, it is possible to prevent deterioration of the insulating property, which is caused by leakage current. Specifically, each non-woven fabric substrate of the non-woven fabric layers 20*a* and 20*b* has a weight per area of 30 $g/m^2$ to 100 $g/m^2$ and a thickness of 0.10 mm to 0.45 mm. The above-mentioned ranges of the weight per area and the thickness are intended to minimize the occurrence of leakage current caused by air in the pores of the non-woven fabric substrate, and the effect of the present invention can not be achieved when the weight per area and the thickness are out of the above ranges.

In particular, each non-woven fabric substrate of the non-woven fabric layers 20*a* and 20*b* has irregularities in which recessed portions and protruding portions are formed on a surface thereof repeatedly. The external waterproof film layer 30*a* and the upper waterproof film layer 11*a* are respectively provided on upper and lower surfaces of the non-woven fabric layer 20*a* provided at an upper portion of the planar heating element 100. The lower waterproof film layer 11*b* and the external waterproof film layer 30*b* are respectively provided on upper and lower surfaces of the non-woven fabric layer 20*b* provided at a lower portion of the planar heating element 100. Therefore, the recessed portions of the surface irregularities of the non-woven fabric layers 20*a* and 20*b* are structured to be blocked by the waterproof film layers provided on the upper and lower surfaces of the non-woven fabric layers 20*a* and 20*b* such that air pockets 21 are formed in the non-woven fabric layers 20*a* and 20*b* and serve to reduce the dielectric constant.

Each one surface of the external waterproof film layers 30*a* and 30*b* may be further provided with non-woven fabric layers 40*a* and 40*b* for construction in order to improve adhesion with mortar or cement. The non-woven fabric layers 40*a* and 40*b* for construction may be made of the same material as or different from the material of the non-woven fabric layers 20*a* and 20*b*.

According to the embodiment of the present invention, it is possible to prevent the occurrence of the leakage current by the air pockets of the non-woven fabric layers as well as by the pores of the non-woven fabric substrate, thereby solving the problem that an earth leakage circuit breaker operates due to a sudden increase in leakage current. Accordingly, wet construction can be performed, power consumption can be reduced, and an electrical fire risk can be remarkably lowered.

According to the present invention, a method of manufacturing a wet planar heating element includes:

a first step S10 in which a non-woven fabric layer 40*a* for construction and an external waterproof film layer 30*a* are laminated together and printed with a logo to obtain a first composite film;

a second step S20 in which a non-woven fabric layer 20*a*, which is formed of fibers in which pores are formed such that the non-woven fabric layer 20*a* has multiple pores and irregularities on the surface thereof, and an upper waterproof film layer 11*a* are laminated together to obtain a second composite film;

a third step S30 in which the first composite film and the second composite film are laminated together to obtain a third composite film;

a fourth step S40 in which a non-woven fabric layer 40*b* for construction and an external waterproof film layer 30*b* are laminated together to obtain a fourth composite film;

a fifth step S50 in which a non-woven fabric layer 20*b*, which is formed of fibers in which pores are formed such that the non-woven fabric layer 20*b* has multiple pores and irregularities on a surface thereof, and a lower waterproof film layer 11*b* are laminated together to obtain a fifth composite film;

a sixth step S60 in which the fourth composite film and the fifth composite film are laminated together to obtain a sixth composite film;

a seventh step S70 in which an electrode layer 13 is formed on one surface of the sixth composite film;

an eighth step S8 in which a planar heating layer 12 is formed on an upper surface of the electrode layer; and a ninth step S90 in which the third composite film and the sixth composite film provided with the electrode layer 13 and the planar heating layer 12 are laminated together.

In each of the above steps, the lamination may be performed by a T-die method, an inflation method, an extrusion lamination method, a coextrusion lamination method, or a bonding method using an adhesive such as epoxy resin, polyurethane, unsaturated polyester, such as a dry lamination method, a sandwich lamination method, and a heat lamination method. Dry lamination with a polyurethane adhesive and an isocyanate curing agent is most preferred.

The seventh step of forming the electrode layer 13 may be formed by various methods such as printing, weaving, embroidery, and adhesion according to characteristics of a material constituting the electrode 15. Specifically, the electrode layer 13 may be formed into ink or paste and printed, or formed into a tape and attached to a substrate. Alternatively, the electrode layer 13 may be impregnated directly on the substrate.

The eighth step of forming the planar heating layer 12 may be formed into ink or paste and then coated or printed, or formed into a tape and then attached to the substrate. Alternatively, the electrode layer 13 may be impregnated directly on the substrate. Here, the coating may be performed by a roll coating method, a Meyer bar coating method, a blade coating method, a gravure coating method, a microgravure coating method, a slot die coating method, a slide coating method, or a curtain coating method.

Figure 2:
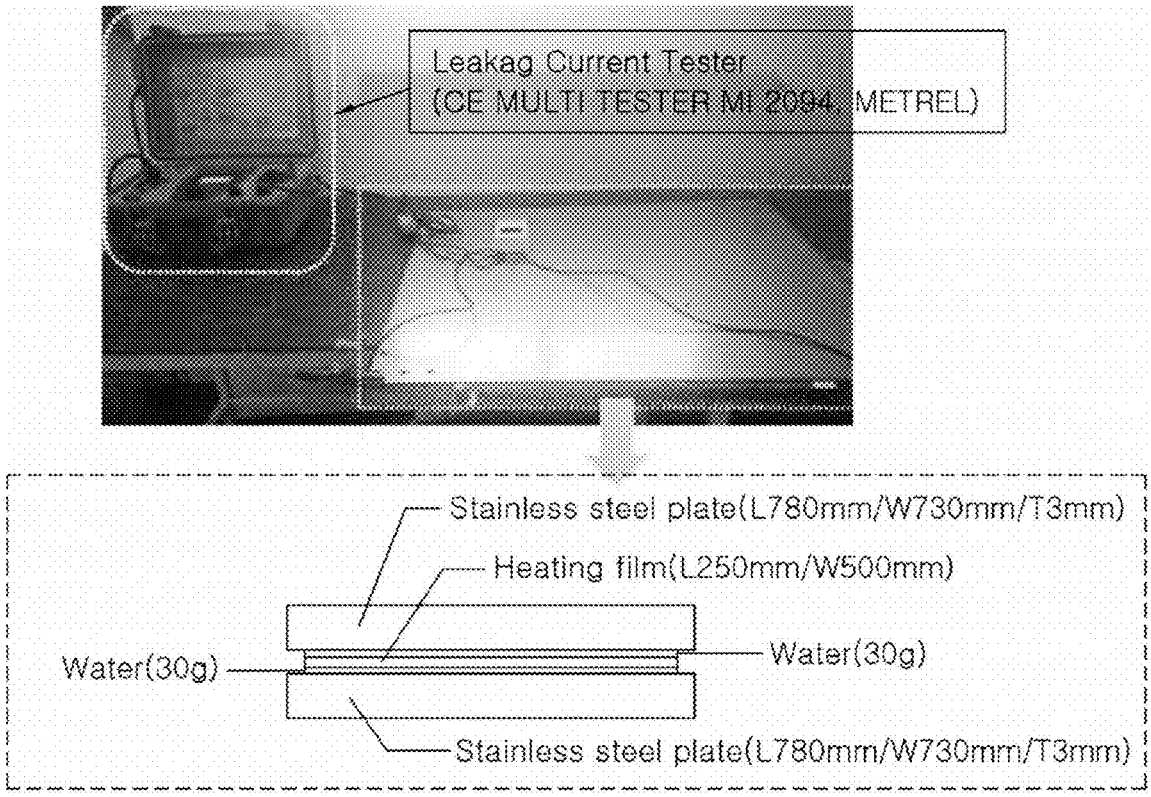
FIG. 2 is a photograph testing leakage current of the planar heating element according to the embodiment of the present invention and a planar heating element of Korea Patent No. 10-1593983 disclosed by the applicant.

FIG. 2 is a photograph testing leakage current of the planar heating element according to the embodiment of the present invention and a planar heating element of Korea Patent No. 10-1593983 disclosed by the applicant.

Here, test conditions were film dimension: L 250 mm/W 500 mm, applied voltage: AC 220±2V (60 Hz), ambient temp.: 21° C., thickness of the nonwoven fabric having the irregularities: 0.17 mm, and weight per area 50 g/m$^2$. As a result of the test, leakage current of the planar heating element having the non-woven fabric layer provided with the irregularities on the surface thereof according to the embodiment of the present invention was 0.42 mA, and leakage current of a planar heating element according to Korean Patent No. 10-1593983, which has a polypropylene film instead of the non-woven fabric layer, was 0.68 mA. It was confirmed that the leakage current is decreased due to the non-woven fabric layer.

FIG. 3 is a test certificate for flexural strength of the planar heating element according to the embodiment of the present invention and the planar heating element of Korean Patent No. 10-1593983 disclosed by the applicant.

Specimens having a length of 55 mm and a width of 25 mm were measured with a tensile testing machine according to KSM 3015 (KS standard) and the flexural strengths were obtained. The flexural strengths of the planar heating element having the non-woven fabric layer (thickness: 0.17 mm, weight per area: 50 g/m$^2$) provided with the irregularities on the surface thereof according to the embodiment of the present invention were 13 N/2.54 cm and 14 N/2.54 cm, and the flexural strengths of the planar heating element according to Korean Patent No. 10-1593983, which has the polypropylene film instead of the non-woven fabric layer, were 25 N/2.54 cm and 18 N/2.54 cm. It was confirmed that the flexibility was improved due to the non-woven fabric layer.

Although the embodiments according to the present invention have been disclosed for illustrative purposes, those skilled in the art will appreciate that various modifications, additions and substitutions are possible, without departing from the scope and spirit of the invention as disclosed in the accompanying claims. It is thus well known to those skilled in that art that the present invention is not limited to the embodiment disclosed in the detailed description, and the patent right of the present invention should be defined by the scope and spirit of the invention as disclosed in the accompanying claims. Accordingly, it should be understood that the present invention includes various modifications, additions and substitutions without departing from the scope and spirit of the invention as disclosed in the accompanying claims.

DESCRIPTION OF REFERENCE NUMERALS IN THE DRAWINGS

10: planar heating unit
11*a*: upper waterproof film layer
11*b*: lower waterproof film layer
12: planar heating layer
13: electrode layer
15: electrode
20*a*, 20*b*: non-woven fabric layer

21: air pocket

30*a*, 30*b*: external waterproof film layer

40*a*, 40*b*: non-woven fabric layer for construction

The invention claimed is:

1. A planar heating element comprising:

a planar heating unit having a planar heating unit including an upper waterproof film layer, a lower waterproof film layer, and a planar heating layer interposed between the upper waterproof film layer and the lower waterproof film layer;

an external waterproof film layer provided on a surface of the planar heating unit;

a non-woven fabric layer interposed between the planar heating unit and the external waterproof film layer and having irregularities on a surface thereof, a non-woven fabric layer for construction provided on the surface of any one of the upper waterproof film layer and the lower waterproof film layer, and at least one layer selected from the group consisting of a metal film, a non-metal film, and a metal and non-metal mixed film, which have an air layer, wherein recessed portions of the irregularities are air pockets closed by any one of the external waterproof film, the upper waterproof film layer and the lower waterproof film layer, wherein the non-woven fabric having the irregularities on the surface thereof is formed of fibers in which pores are formed such that the non-woven fabric layer has multiple pores, wherein the non-woven fabric having the irregularities on the surface thereof has a weight per area of 30 g/m$^2$ to 100 g/m$^2$ and a thickness of 0.10 mm to 0.45 mm, wherein the upper waterproof film layer or the lower waterproof film layer is made of a material selected from the group consisting of polyethylene terephthalate, polypropylene, polyester, polystyrene, polyether ether ketone, polyethylene terephthalate glycol-modified, and polyethyleneimide, wherein the planar heating element comprises polymer PTC constant-temperature heating ink, wherein the planar heating element has a flexural strength of 13 N/2.54 cm to 14 N/2.54 cm, wherein the planar heating element is constructed on cement or mortar for wet construction.

2. A method of manufacturing a planar heating element, the method comprising:

laminating a non-woven fabric layer for construction and an external waterproof film layer laminated to obtain a first composite film;

laminating a non-woven fabric layer which is formed of fibers in which pores are formed such that the non-woven fabric layer has multiple pores and irregularities on the surface thereof, and an upper waterproof film layer to obtain a second composite film;

laminating the first composite film and the second composite film to obtain a third composite film;

laminating a non-woven fabric layer for construction and an external waterproof film layer to obtain a fourth composite film;

laminating a non-woven fabric layer, which is formed of fibers in which pores are formed such that the non-woven fabric layer has multiple pores and irregularities on a surface thereof, and a lower waterproof film layer to obtain a fifth composite film;

laminating the fourth composite film and the fifth composite film to obtain a sixth composite film;

forming an electrode layer on one surface of the sixth composite film;

forming a planar heating layer on an upper surface of the electrode layer; and laminating the third composite film and the sixth composite film provided with the electrode layer and the planar heating layer;

wherein recessed portions of the irregularities are air pockets closed by any one of the external waterproof film, the upper waterproof film layer and the lower waterproof film layer, wherein the non-woven fabric having the irregularities on the surface thereof is formed of fibers in which pores are formed such that the non-woven fabric layer has multiple pores, wherein the non-woven fabric having the irregularities on the surface thereof has a weight per area of 30 g/m$^2$ to 100 g/m$^2$ and a thickness of 0.10 mm to 0.45 mm, wherein the upper waterproof film layer or the lower waterproof film layer is made of a material selected from the group consisting of polyethylene terephthalate, polypropylene, polyester, polystyrene, polyether ether ketone, polyethylene terephthalate glycol-modified, and polyethyleneimide, wherein the planar heating element comprises polymer PTC constant-temperature heating ink, wherein the planar heating element has a flexural strength of 13 N/2.54 cm to 14 N/2.54 cm, wherein the planar heating element is constructed on cement or mortar for wet construction.

* * * * *